US009373903B2

(12) United States Patent
Chang

(10) Patent No.: US 9,373,903 B2
(45) Date of Patent: Jun. 21, 2016

(54) FLEXIBLE FLAT CABLE CONNECTOR AND FLEXIBLE FLAT CABLE THEREOF

(71) Applicant: Wei Sun Chang, Taipei (TW)

(72) Inventor: Wei Sun Chang, Taipei (TW)

( * ) Notice: Subject to any disclaimer, the term of this patent is extended or adjusted under 35 U.S.C. 154(b) by 0 days.

(21) Appl. No.: 14/607,226

(22) Filed: Jan. 28, 2015

(65) Prior Publication Data

US 2015/0214644 A1 Jul. 30, 2015

(30) Foreign Application Priority Data

Jan. 28, 2014 (TW) ..... 103201814
Jan. 28, 2014 (TW) ..... 103201815

(51) Int. Cl.

| | |
|---|---|
| ***H01R 13/62*** | (2006.01) |
| ***H01R 12/59*** | (2011.01) |
| ***H01R 12/70*** | (2011.01) |
| ***H01R 12/72*** | (2011.01) |
| ***H01R 12/79*** | (2011.01) |

(52) U.S. Cl.

CPC ..... *H01R 12/594* (2013.01); *H01R 12/7082* (2013.01); *H01R 12/721* (2013.01); *H01R 12/79* (2013.01)

(58) Field of Classification Search

USPC ..... 439/325, 329, 493, 498, 638
See application file for complete search history.

(56) References Cited

U.S. PATENT DOCUMENTS 4,139,727 A * 2/1979 Kuballa ..... H01R 12/62 174/135
5,928,029 A * 7/1999 Lam ..... H01R 12/777 439/495
6,146,190 A * 11/2000 Fuerst ..... H01R 12/81 439/496
6,244,890 B1 * 6/2001 Fuerst ..... H01R 13/6273 439/352
6,626,698 B2 * 9/2003 Matsumura ..... H05K 1/118 439/496
8,512,071 B2 8/2013 Tseng et al.
8,927,867 B2 * 1/2015 Konya ..... H01B 7/0838 174/117 F
9,033,744 B2 * 5/2015 Chen ..... H01R 12/721 439/660
9,077,124 B2 * 7/2015 Chen ..... H01R 12/721
2013/0303018 A1 11/2013 Tseng et al.

FOREIGN PATENT DOCUMENTS

CN 202503124 U 10/2012
TW M413241 U 10/2011

* cited by examiner

*Primary Examiner* — Tho D Ta
(74) *Attorney, Agent, or Firm* — Osha Liang LLP

(57) ABSTRACT

A flexible flat cable connector is described. The flexible flat cable connector comprises an insulating housing having first terminal holes in front end of the insulating housing and having second terminal holes in rear end of the insulating housing, wherein first terminal holes and second terminal holes are arranged in upward/downward dual-row configuration to form first insertion space and second insertion space respectively; and a plurality of terminals, forwardly extending each terminal to form first resilient portion and backwardly extending to form either second resilient portion or soldering portion, wherein terminals are secured inside the insulating housing in upward/downward dual-row configuration, first resilient portions are inserted to first insertion space and arranged in upward/downward dual-row configuration, and second resilient portions are inserted to second insertion space and arranged in upward/downward dual-row configuration; wherein soldering portions of terminals are arranged in and exposed from rear end of the insulating housing.

19 Claims, 18 Drawing Sheets

FLEXIBLE FLAT CABLE CONNECTOR AND FLEXIBLE FLAT CABLE THEREOF

BACKGROUND OF THE INVENTION

1. Field of Invention

The present invention relates to a flexible flat cable connector, and more particularly to a flexible flat cable connector with a first insertion space and/or a second insertion space wherein a plurality of terminals are disposed within the flexible flat cable connector in a upward/downward dual-row configuration, a plurality of first resilient portions of terminals are arranged within the first insertion space in the upward/downward dual-row configuration, and/or a plurality of second resilient portions of terminals are arranged within the second insertion space in the upward/downward dual-row configuration.

2. Description of Prior Art

Conventionally, Taiwan Patent No. M413241 entitled "Electrical connector assembly having a printed circuit board with soldering holes interconnected to a plurality of contacts" (also published as China Patent No. CN202503124U and U.S. Pat. No. 8,512,071) disclosed a connector assembly. The connector assembly is provided with an insulating housing, a plurality of data and power terminals, a printed circuit board (PCB) and a flexible flat cable (FFC), wherein the data and power terminals inserted in the insulating housing, the PCB secured to the insulating housing, the FFC soldered on the PCB, the data and power terminals are electrically interconnected the FFC by the PCB. The provision of the unitary construction feature of FFC can save the production cost due to its eliminating cable management equipment and the operation of cable managing processes. However, the conventional FFC is constructed by a single-row arrangement to form a larger width and there is a need to enhance the structural strength of FFC. Furthermore, after the FFC is electrically connected to the PCB in the connector assembly, FFC and PCB are easily damaged if the user desires to extract FFC from the PCB. Therefore, the user is unable to insert the FFC into or remove the FFC from the connector assembly repeatedly.

SUMMARY OF THE INVENTION

To solve the aforementioned problems, one objective of the present invention is to provide a flexible flat cable connector. The flexible flat cable comprises an insulating housing having a plurality of first terminal holes in a front end of the insulating housing and having a plurality of second terminal holes in a rear end of the insulating housing, wherein the first terminal holes and the second terminal holes are arranged in an upward/downward dual-row configuration to form a first insertion space and a second insertion space respectively; and a plurality of terminals, forwardly extending each terminal to form a first resilient portion and backwardly extending to form either a second resilient portion or a soldering portion, wherein the terminals are secured inside the insulating housing in the upward/downward dual-row configuration, the first resilient portions are inserted to the first insertion space and arranged in the upward/downward dual-row configuration, and the second resilient portions are inserted to the second insertion space and arranged in the upward/downward dual-row configuration in order to insert the FFC into or remove the FFC from the FFC connector repeatedly; wherein the soldering portions of the terminals are arranged in and exposed from the rear end of the insulating housing.

In one embodiment, the first insertion space is plugged by a cramp portion of a first PCB, and a front-side and a backside of the cramp portion respectively comprise a plurality of conducting portions to allow the first resilient portions to fasten the cramp portion and electrically contact the conducting portions on the front-side and the backside of the cramp portion respectively.

In one embodiment, the first insertion space is plugged by a cramp portion of a first PCB, and a front-side and a backside of the cramp portion respectively comprise a plurality of conducting portions to allow the first resilient portions to fasten the cramp portion and electrically contact the conducting portions on the front-side and the backside of the cramp portion respectively.

In one embodiment, the first insertion space is plugged by a cramp portion of a first PCB, the first PCB comprises a slot and a position portion, a front-side and a backside of the cramp portion respectively comprise a plurality of conducting portions, a lateral side of the insulating housing is embedded to the slot of the first PCB and a position block of the insulating housing is buckled to the position portion of the first PCB, and the first resilient portions fasten the cramp portion and electrically contact the conducting portions on the front-side and the backside of the cramp portion respectively.

In one embodiment, the second insertion space is inserted by the FFC comprising a plurality of first conductors and a plurality of second conductors, the first conductors and the second conductors are exposed from the front end of the FFC, a holding part is disposed in the front end of the FFC wherein the holding part comprises a pair of resilient hooks for hooking the front end to the pair of buckling parts of the FFC connector, and the second resilient portions clamp the front end of the FFC so that the second resilient portions electrically contact the first conductors and the second conductors respectively.

In one embodiment, the soldering portions are disposed in a second PCB comprising a plurality of conducting portions for electrically connecting the soldering portions to the conducting portions of the second PCB.

In one embodiment, the first insertion space is inserted by the FFC comprising a plurality of first conductors and a plurality of second conductors, the first conductors and the second conductors are exposed from the rear end of the FFC, a holding part is disposed in the rear end of the FFC wherein the holding part comprises a pair of resilient hooks for hooking the front end to the pair of buckling parts of the FFC connector, and the first resilient portions clamp the rear end of the FFC so that the first resilient portions electrically contact the first conductors and the second conductors respectively.

In one embodiment, the second insertion space is inserted by the FFC comprising a plurality of first conductors and a plurality of second conductors, the first conductors and the second conductors are exposed from the front end of the FFC, and the second resilient portions clamp the front end of the FFC so that the second resilient portions electrically contact the first conductors and the second conductors respectively.

In one embodiment, the FFC covers the first conductors by a first insulation layer and covers the second conductors by a second insulation layer, the first insulation layer and the second insulation layer are formed by bending an identical insulation layer, at least one of a first shielding layer and a second shielding layer is disposed between the first insulation layer and the second insulation layer, and a third shielding layer covers an outer surface of a main body section.

In one embodiment, the first contact surface region of the first conductors is exposed from a first contact section of the first insulation layer, the second contact surface region of the second conductors is exposed from a second contact section of the second insulation layer, the second resilient portions clamps the first contact section and the second contact section for electrically connecting the first contact surface region and second contact surface region respectively, and at least one of the first shielding layer and the second shielding layer extends to an in-between position of the first contact section and the second contact section.

In one embodiment, the first contact surface region of the first conductors is exposed from a first contact section of the first insulation layer, the second contact surface region of the second conductors is exposed from a second contact section of the second insulation layer, the second resilient portions clamps the first contact section and the second contact section for electrically connecting the first contact surface region and second contact surface region respectively, and at least one of a first insulation supporting plate and a second insulation supporting plate is disposed in an in-between position of the first contact section and second contact section.

In one embodiment, the FFC covers the first conductors by a first insulation layer and covers the second conductors by a second insulation layer, and a vertical distance between the first conductors and the second conductors is greater than twice the thickness of either the first conductors or the second conductors.

In one embodiment, the first insulation layer and the second insulation layer are stacked by way of a glue manner, the first insulation layer and the second insulation layer is an individual insulation layer respectively or the first insulation layer and the second insulation layer are formed by bending an identical insulation layer.

In one embodiment, the first conductors and the second conductors are interlaced upward and downward or the first conductors and the second conductors are disposed correspondingly upward and downward.

In one embodiment, the first insertion space is inserted by the FFC comprising a plurality of first conductors and a plurality of second conductors, the first conductors and the second conductors are exposed from the rear end of the FFC, and the first resilient portions clamp the rear end of the FFC.

In one embodiment, the FFC covers the first conductors by a first insulation layer and covers the second conductors by a second insulation layer, the first insulation layer and the second insulation layer are formed by bending an identical insulation layer, at least one of a first shielding layer and a second shielding layer is disposed between the first insulation layer and the second insulation layer, and a third shielding layer covers an outer surface of a main body section.

In one embodiment, the first contact surface region of the first conductors is exposed from a first contact section of the first insulation layer, the second contact surface region of the second conductors is exposed from a second contact section of the second insulation layer, the first resilient portions clamps the first contact section and the second contact section for electrically connecting the first contact surface region and second contact surface region respectively, and at least one of the first shielding layer and the second shielding layer extends to an in-between position of the first contact section and the second contact section.

In one embodiment, the first contact surface region of the first conductors is exposed from a first contact section of the first insulation layer, the second contact surface region of the second conductors is exposed from a second contact section of the second insulation layer, the first resilient portions clamps the first contact section and the second contact section for electrically connecting the first contact surface region and second contact surface region respectively, and at least one of a first insulation supporting plate and a second insulation supporting plate is disposed in an in-between position of the first contact section and second contact section.

In one embodiment, the FFC covers the first conductors by a first insulation layer and covers the second conductors by a second insulation layer, and a vertical distance between the first conductors and the second conductors is greater than twice the thickness of either the first conductors or the second conductors.

In one embodiment, the first insulation layer and the second insulation layer are stacked by way of a glue manner, the first insulation layer and the second insulation layer is an individual insulation layer respectively or the first insulation layer and the second insulation layer are formed by bending an identical insulation layer.

In one embodiment, the first conductors and the second conductors are interlaced upward and downward or the first conductors and the second conductors are disposed correspondingly upward and downward.

The advantages of FFC connector and FFC are described below. The FFC covers the first conductors by first insulation layer and covers the second conductors by second insulation layer. A first shielding layer is disposed between the first insulation layer and second insulation layer. A third shielding layer covers the outer surface of a main body section. The first contact surface region of first conductors is exposed from the first contact section of first insulation layer and the second contact surface region of second conductors is exposed from the second contact section of second insulation layer. When the second insertion space is inserted by the front end of FFC, second resilient portions clamps the front end of FFC which is composed of first contact section and second contact section so that the second resilient portions electrically connect the first contact surface region and second contact surface region respectively. Thus, FFC connector can be easily plugged by FFC for electrically connecting the first PCB to the FFC by way of the FFC connector. Furthermore, the FFC can be extracted from the FFC connector on demand in order to release the electrical connection between the first PCB and the FFC. In one case, the FFC connector serves as a cable adapter attached to the first PCB to change FFC or repair the electronic device attached to the first PCB advantageously. In another case, both the FFC connector and FFC may be extracted from the first PCB to release the electrical connection between the first PCB and the FFC in order to repair the electronic device attached to the first PCB advantageously.

Additional advantages of FFC connector and FFC are described below, the FFC connector further includes a pair of buckling parts on the outer side of the insulating housing and a holding part is disposed in the front end of FFC wherein the holding part includes a pair of resilient hooks for hooking the front end of FFC to the pair of buckling parts of FFC connector to prevent the FFC from the FFC connector due to external force. If there is a need to separate the FFC from the FFC connector, the pair of resilient hooks is pressed to release the pair of resilient hooks from the pair of buckling parts of insulating housing for withdrawing the FFC from the FFC connector.

DETAILED DESCRIPTION OF THE PREFERRED EMBODIMENTS

The foregoing aspects and many of the attendant advantages of this invention will become more readily appreciated as the same becomes better understood by reference to the following detailed description but rather than limiting of the present invention.

Figure 1:
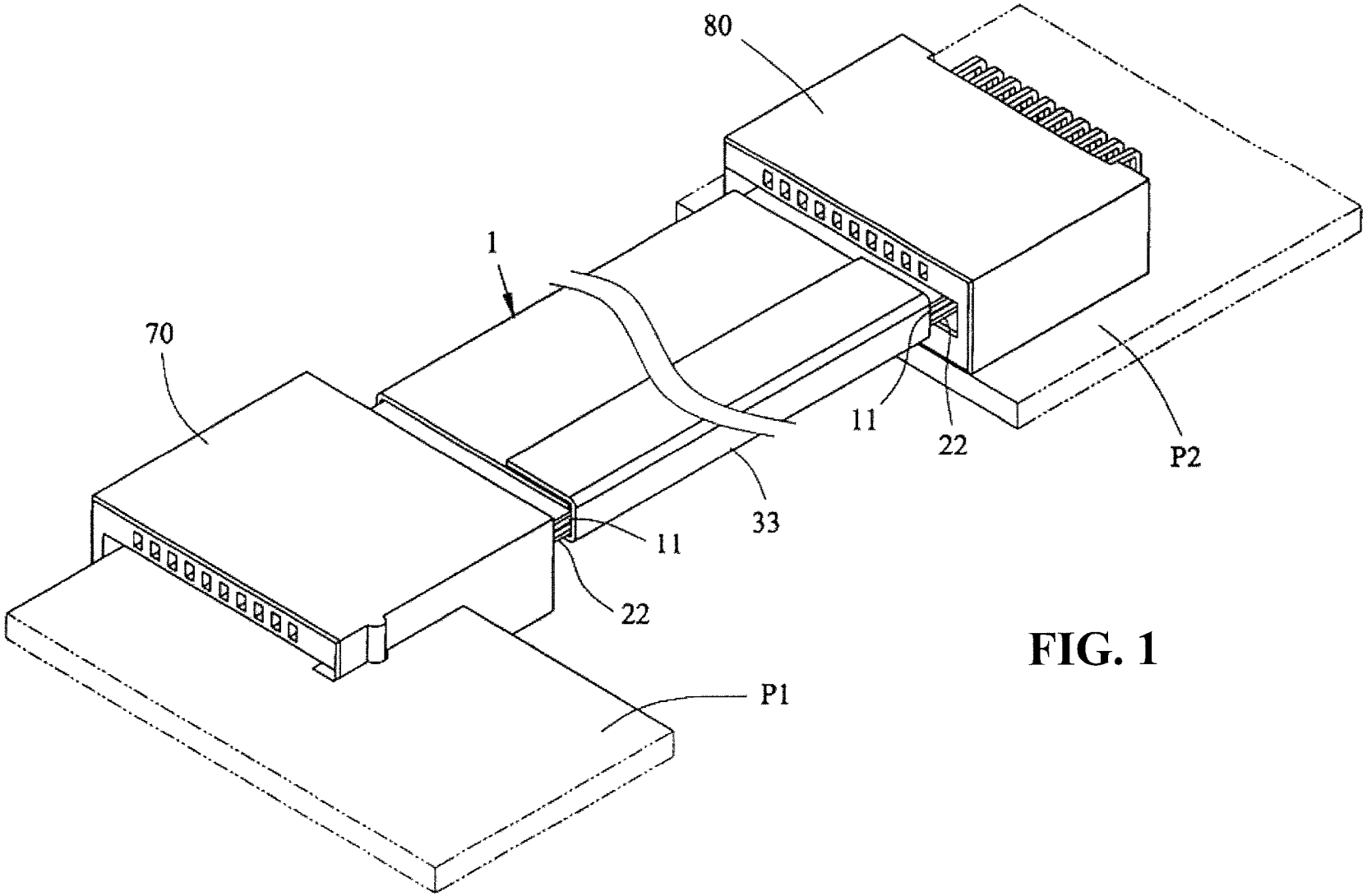
FIG. 1 is a schematic view of a flexible flat cable connecting one FFC connector to the other FFC connector according to one preferred embodiment of the present invention.
Figure 2:
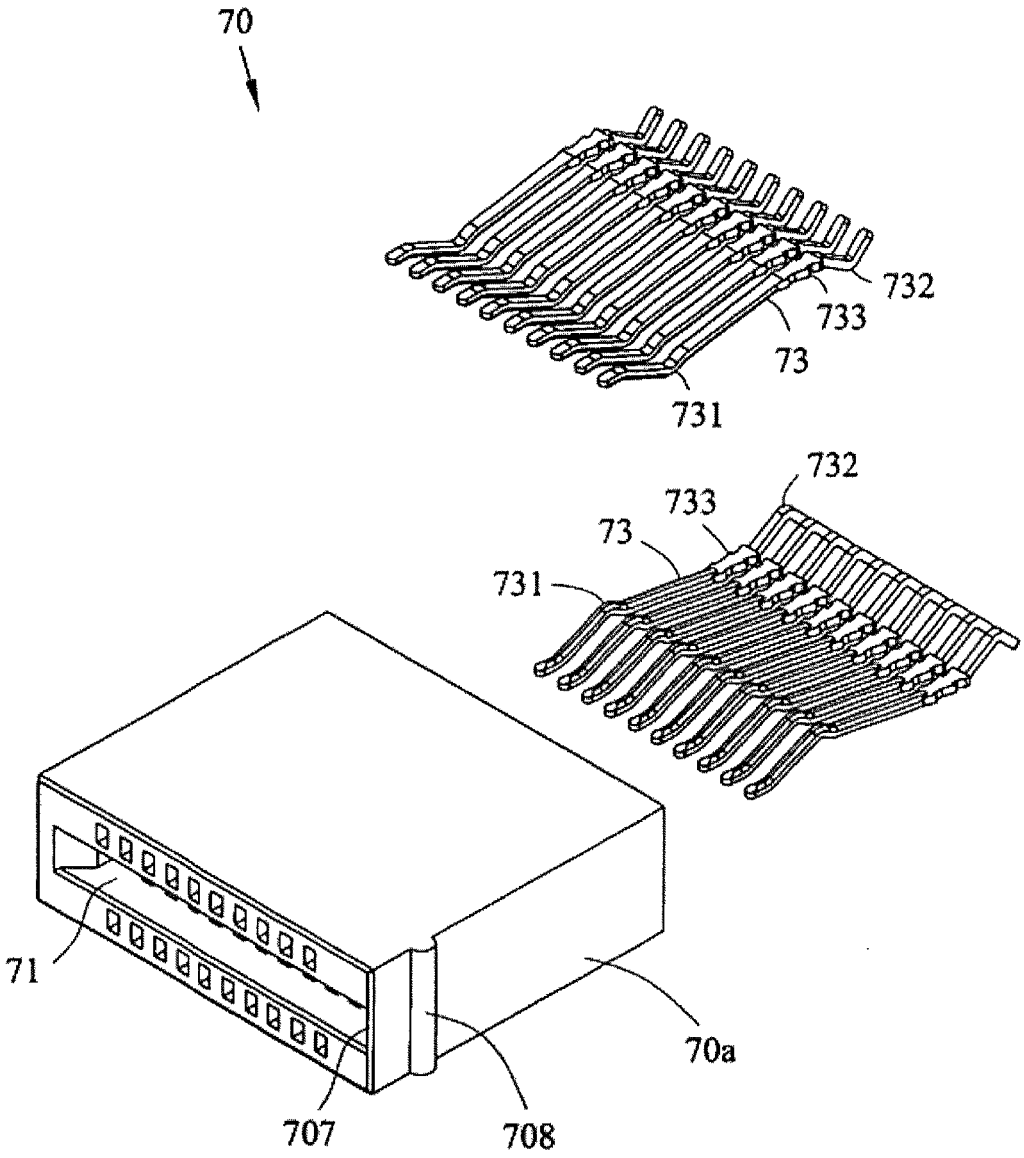
FIG. 2 is a schematic exploded three-dimensional view of a flexible flat cable (FFC) connector according to a first preferred embodiment of the present invention.

FIG. 1 is a schematic view of a flexible flat cable 1 connecting one FFC connector 70 to the other FFC connector 80 according to one preferred embodiment of the present invention. For example, the first contact section 11 and the second contact section in the front end and rear end of the flexible flat cable 1 are inserted to the one FFC connector 70 and the other FFC connector 80 respectively. The one FFC connector 70 electrically connects to circuit board P1 of electronic device, e.g. the circuit board of hard disk drive or storage device, but not limited, and the other FFC connector 80 electrically connects to another circuit board P2 of electronic device, e.g. the main circuit board of personal computer of notebook computer, but not limited. Additionally, the flexible flat cable 1 of the present invention is capable of easily inserting to the one FFC connector 70 and the other FFC connector 80 and/or extracting from the one FFC connector 70 and the other FFC connector 80 advantageously. In other words, the flexible flat cable 1 electrically connected to other FFC connector 80 can be easily replaced and the other FFC connector 80 can be released from the one FFC connector 70 effortlessly. In other words, the FFC connector 80 is easily able to change the FFC 1. The electric connection between the FFC connector 70 and FFC connector 80 is released with ease.

Referring to FIG. 2 through FIG. 7, the flexible flat cable connector 70 in the present invention includes an insulating housing 70*a* and a plurality of terminals 73 wherein the front end of the insulating housing 70*a* includes a plurality of first terminal holes 701 and the rear end of the insulating housing 70*a* includes a plurality of second terminal holes 702. The first terminal holes 701 and second terminal holes 702 are arranged in an upward/downward dual-row configuration to form a first insertion space 71 and a second insertion space 72 respectively. Each terminal 73 extends forward to form a first resilient portion 731 and extends backward to form a second resilient portion 732 wherein the terminals 73 are secured inside the insulating housing 70*a* in a upward/downward dual-row configuration. For example, a plurality of grooves 703 are disposed in the insulating housing 70*a* and piercer 733 of each terminal 73 embeds to grooves 703. The first resilient portions 731 are inserted to the first insertion space 71 and are arranged in a upward/downward dual-row configuration and second resilient portions 732 are inserted to the second insertion space 72 and are arranged in a upward/ downward dual-row configuration so that the first insertion space 71 is plugged by a cramp portion P11 of first PCB P1 in FIG. 3 through FIG. 6 wherein front-side P12 and backside P13 of the cramp portion P11 include a plurality of conducting portions P15, P16. When first insertion space 71 is plugged by the cramp portion P11, the first resilient portions 731 fastens the cramp portion P11 and electrically contacts the conducting portions P15, P16 on the front-side P12 and backside P13 of cramp portion P11 respectively. Furthermore, the second insertion space 72 is inserted by the FFC 1 including a plurality of first conductors 50 and a plurality of second conductors 60 wherein the first conductors 50 and second conductors 60 are exposed from the front end 11*a* of FFC 1. When the second insertion space 72 is inserted by the front end 11*a* of FFC 1, second resilient portions 732 clamp the front end 11*a* of FFC 1 so that the second resilient portions 732 electrically connects the first conductors 50 and second conductors 60 respectively in order to insert the FFC 1 into or remove the FFC 1 from the FFC connector 70 repeatedly.

Figure 3:
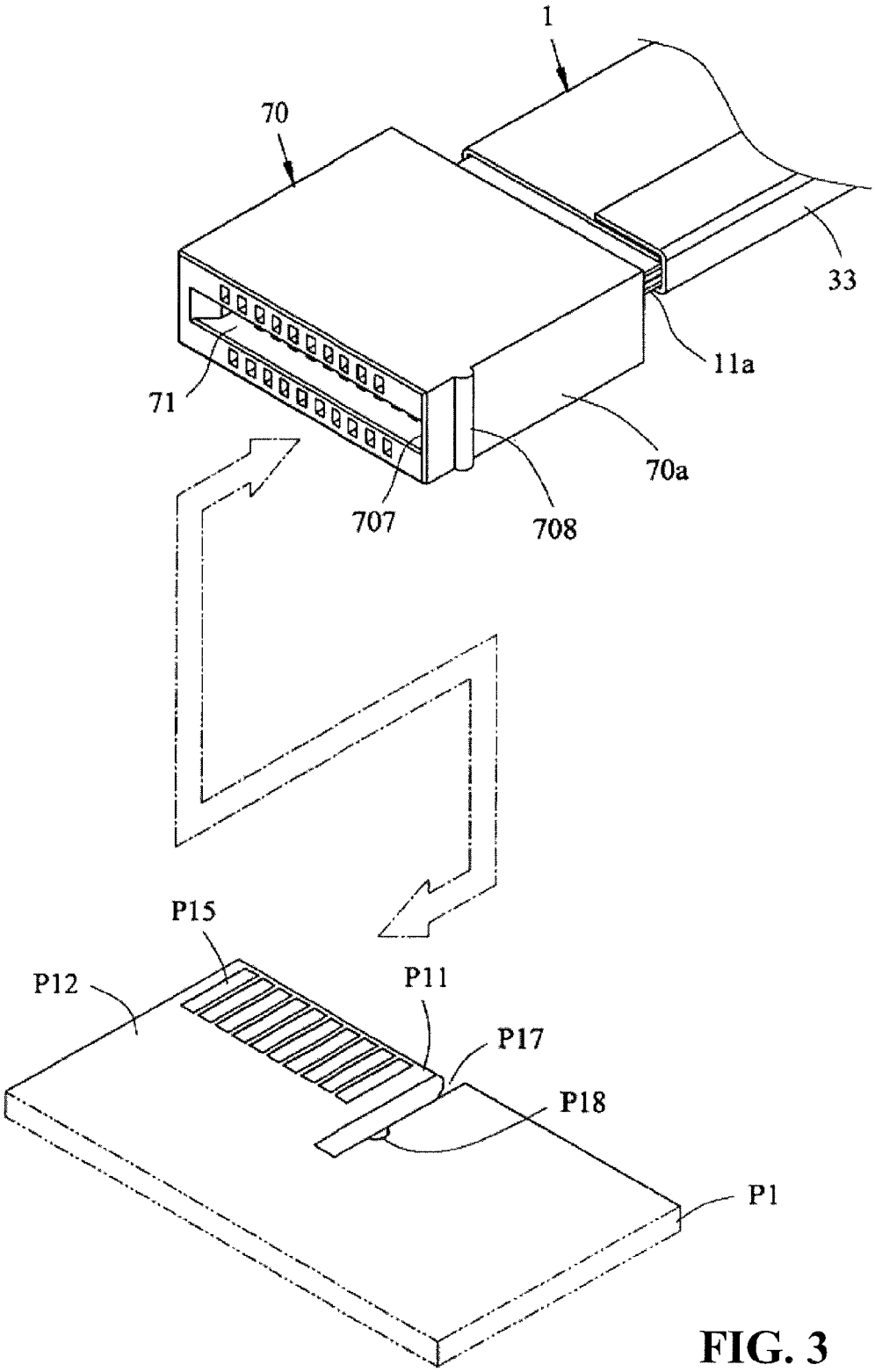
FIG. 3 is a schematic three-dimensional view of assembling the FFC connector to the FFC and separating from the first PCB according to a first preferred embodiment of the present invention.
Figure 7:
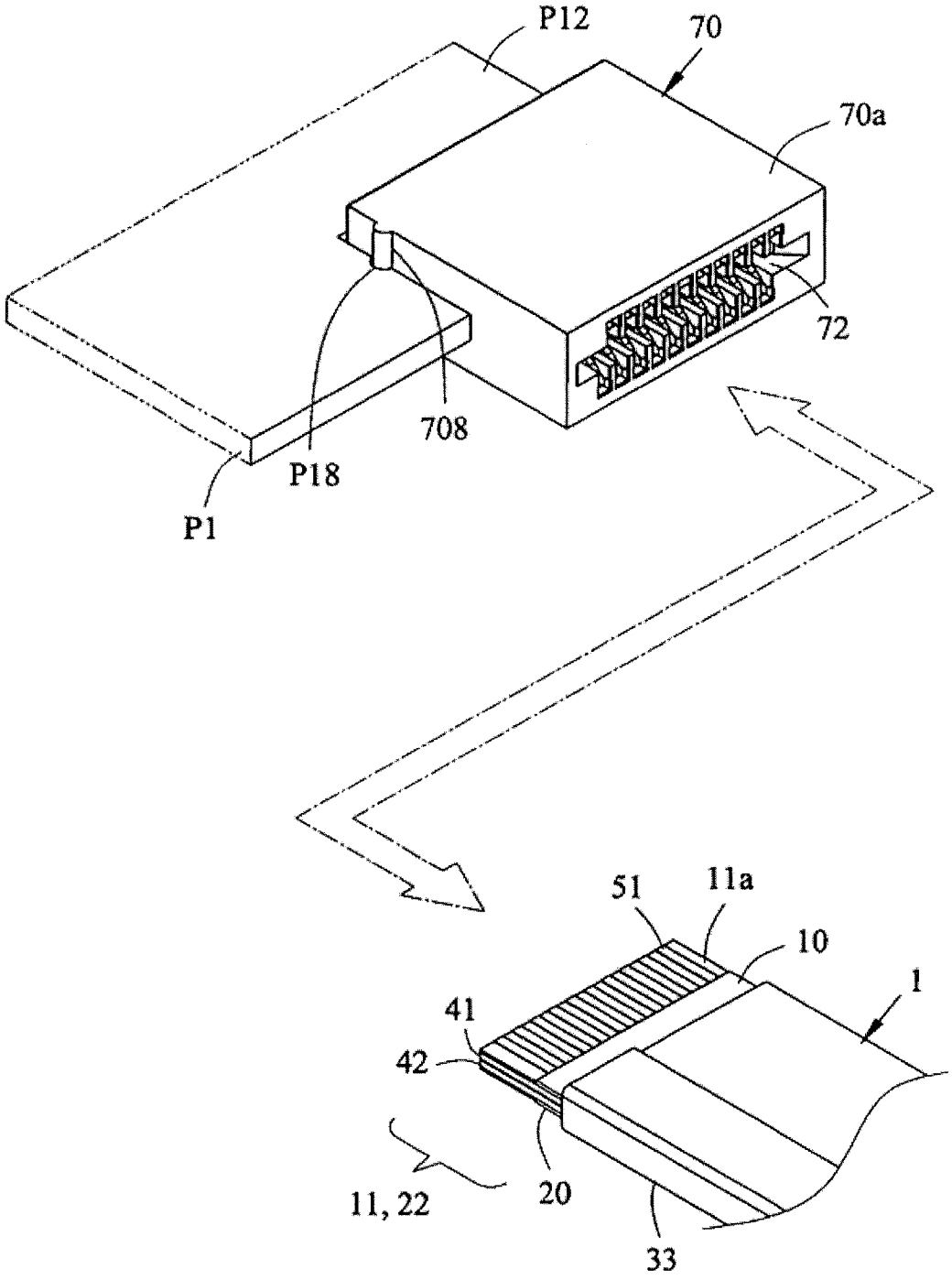
FIG. 7 is a schematic three-dimensional view of assembling FFC connector to the first PCB and separating from the FFC according to a first preferred embodiment of the present invention.

The embodiments, implements and advantages of FFC connector 70 and FFC 1 are described below. The FFC 1 covers the first conductors 50 by first insulation layer 10 and covers the second conductors 60 by second insulation layer 20. A first shielding layer 31 is disposed between the first insulation layer 10 and second insulation layer 20. A third shielding layer 33 covers the outer surface of a main body section 12. The first contact surface region 51 of first conductors 50 is exposed from the first contact section 11 of first insulation layer 10 and the second contact surface region 62 of second conductors 60 is exposed from the second contact section 22 of second insulation layer 20. When the second insertion space 72 is inserted by the front end 11*a* of FFC 1, second resilient portions 732 clamps the front end 11*a* of FFC 1 which is composed of first contact section 11 and second contact section 22 so that the second resilient portions 732 electrically connect the first contact surface region 51 and second contact surface region 62 respectively. Thus, FFC connector 70 can be easily plugged by FFC 1 for electrically connecting the first PCB P1 to the FFC 1 by way of the FFC connector 70. Furthermore, the FFC 1 can be extracted from the FFC connector 70 on demand in order to release the electrical connection between the first PCB P1 and the FFC 1, as shown in FIG. 7. In one case, the FFC connector 70 serves as a cable adapter attached to the first PCB P1 to change FFC 1 or repair the electronic device (not shown) attached to the first PCB 1 advantageously. In another case, both the FFC connector 70 and FFC 1 may be extracted from the first PCB 1 to release the electrical connection between the first PCB P1 and the FFC 1, as shown in FIG. 3, in order to repair the electronic device (not shown) attached to the first PCB P1 advantageously.

Figure 4:
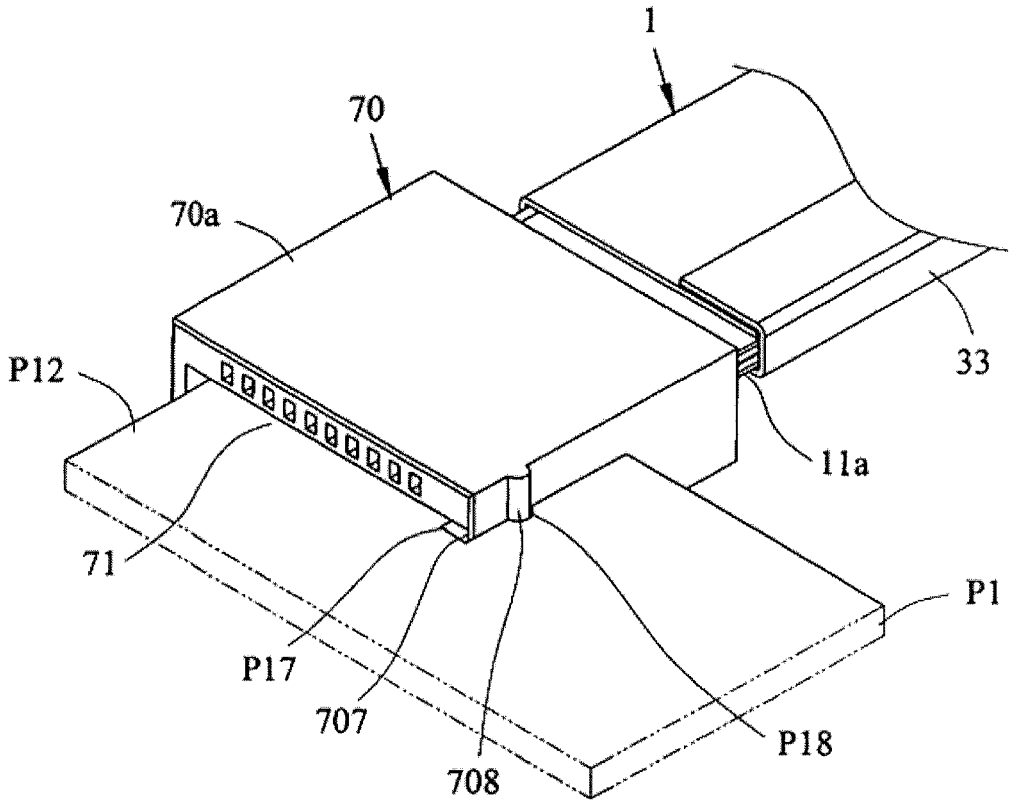
FIG. 4 is a schematic three-dimensional view of assembling the FFC connector to the FFC and connecting the FFC connector to the first PCB according to a first preferred embodiment of the present invention.
Figure 5:
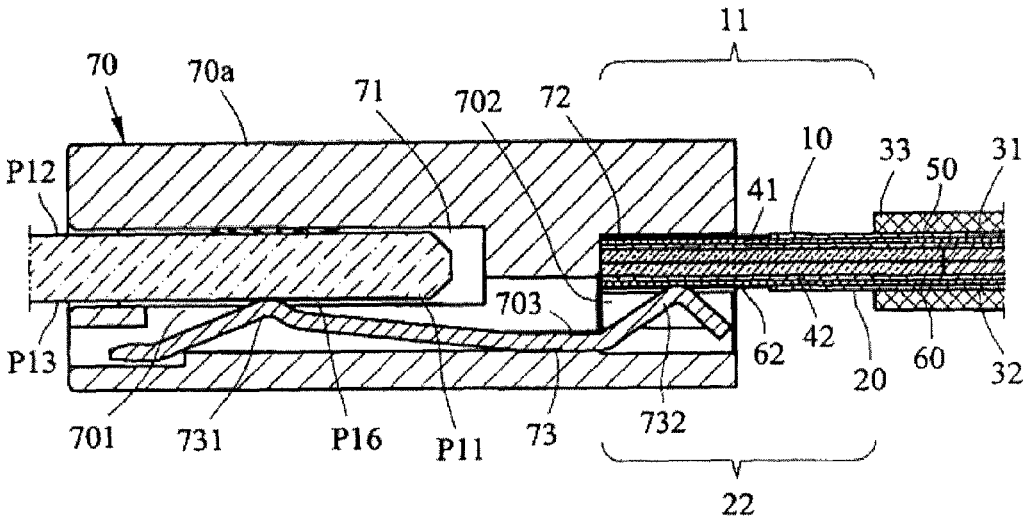
FIG. 5 is a schematic cross-sectional view of assembling the FFC connector to the FFC and connecting the FFC connector to the first PCB according to a first preferred embodiment of the present invention.
Figure 6:
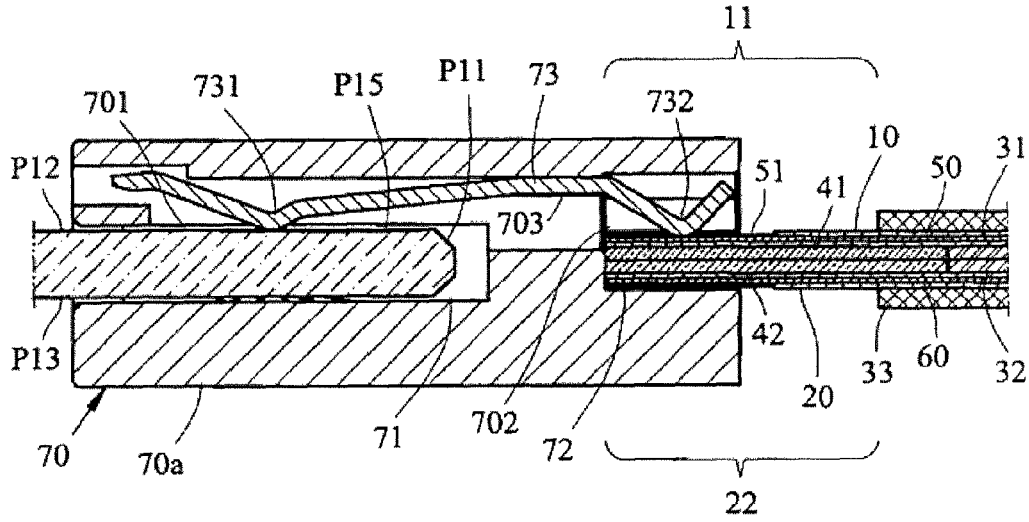
FIG. 6 is another schematic cross-sectional view of assembling the FFC connector to the FFC and connecting the FFC connector to the first PCB according to a first preferred embodiment of the present invention.

The position arrangement of FFC connector 70 and first PCB P1 is described below. The first PCB P1 includes a slot P17 and a position portion P18 wherein a lateral side 707 of insulating housing 70*a* is embedded to slot P17 of first PCB P1 and a position block 708 of insulating housing 70*a* is buckled to the position portion P18 of first PCB P1 such that the FFC connector 70 is stably fastened to the first PCB P1, as shown in FIGS. 3 and 4. The first resilient portions 731 electrically connect the conducting portions P15, P16 on the front-side P12 and backside P13 of cramp portion P11 respectively. Moreover, when the FFC connector 70 is extracted from the first PCB P1, the position block 708 of insulating housing 70*a* separates from the position portion P18 of first PCB P1 and the lateral side 707 of insulating housing 70*a* withdraws from the slot P17 of first PCB P1.

Figure 8:
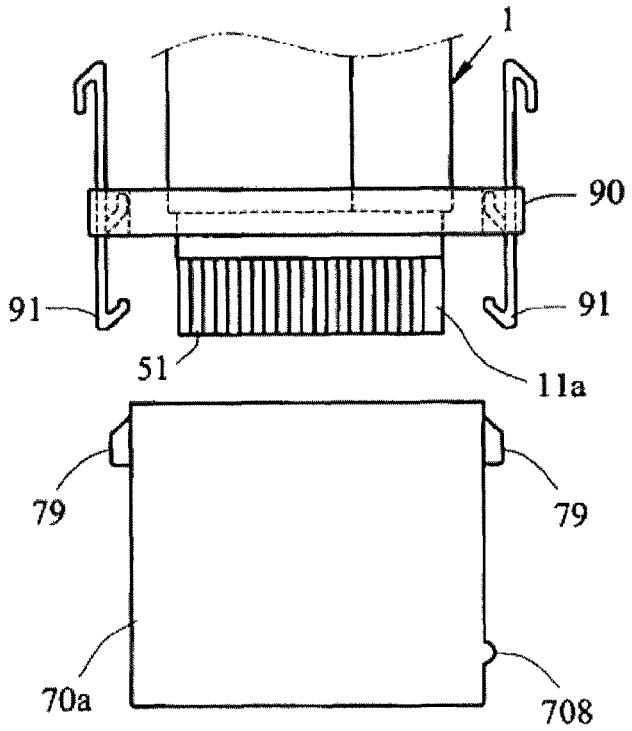
FIG. 8 is a schematic planar view of separating the FFC connector from the FFC according to a second preferred embodiment of the present invention.
Figure 9:
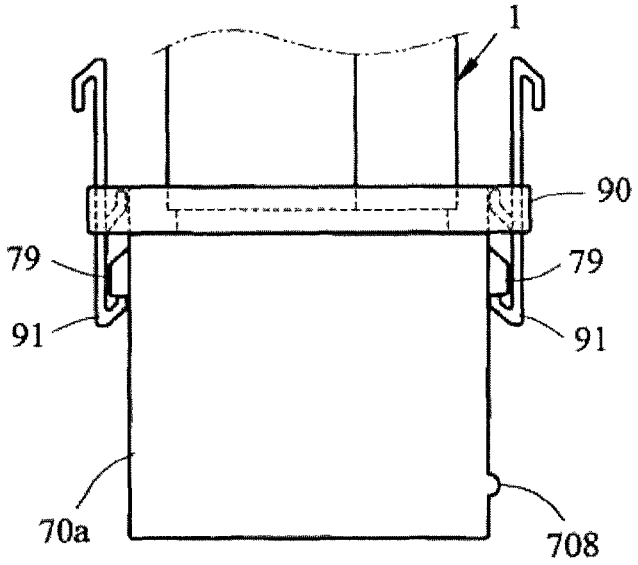
FIG. 9 is a schematic planar view of assembling the FFC connector to the FFC according to a second preferred embodiment of the present invention.
Figure 10:
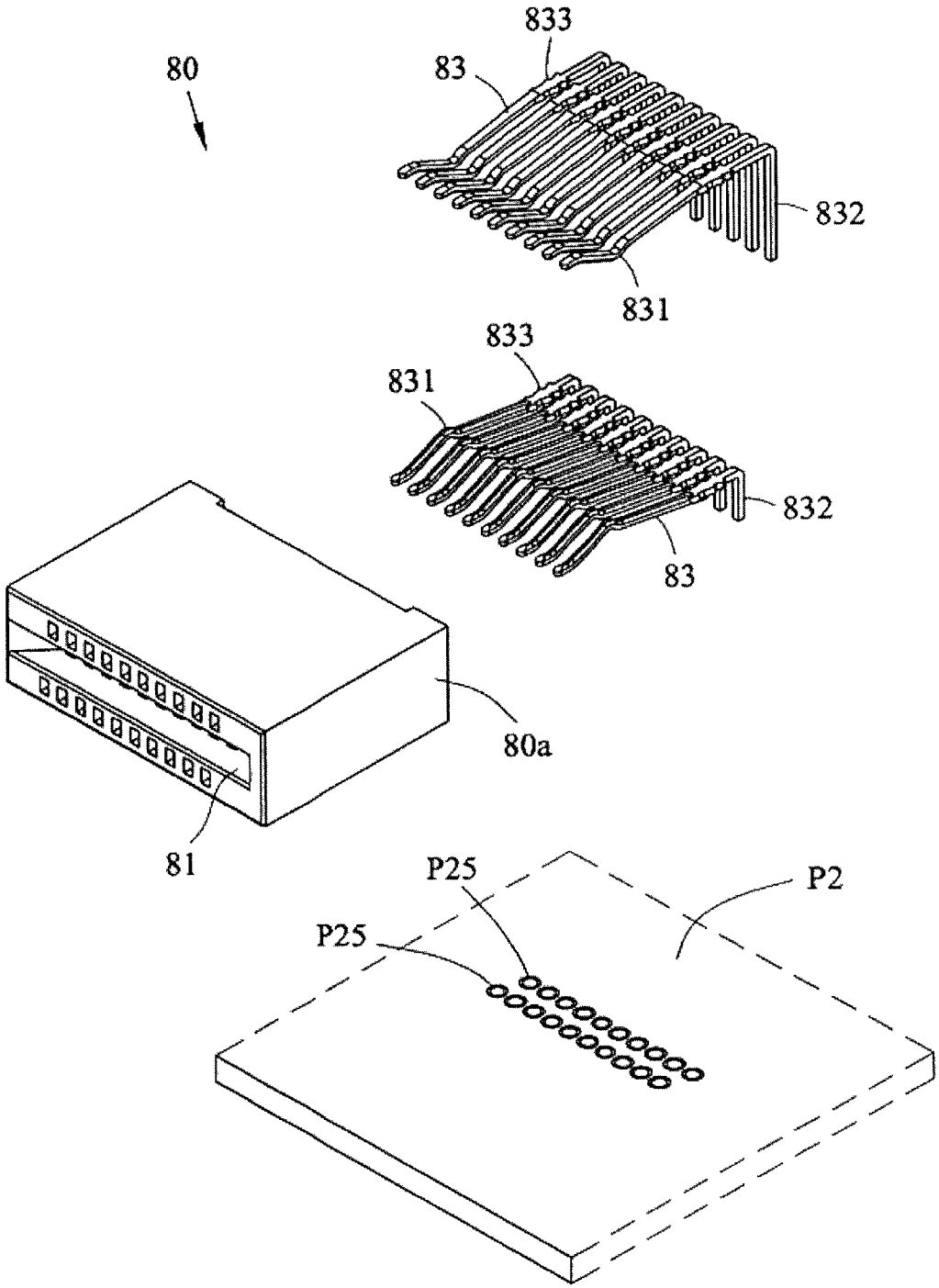
FIG. 10 is a schematic exploded three-dimensional view of a flexible flat cable connector according to a third preferred embodiment of the present invention.
Figure 11:
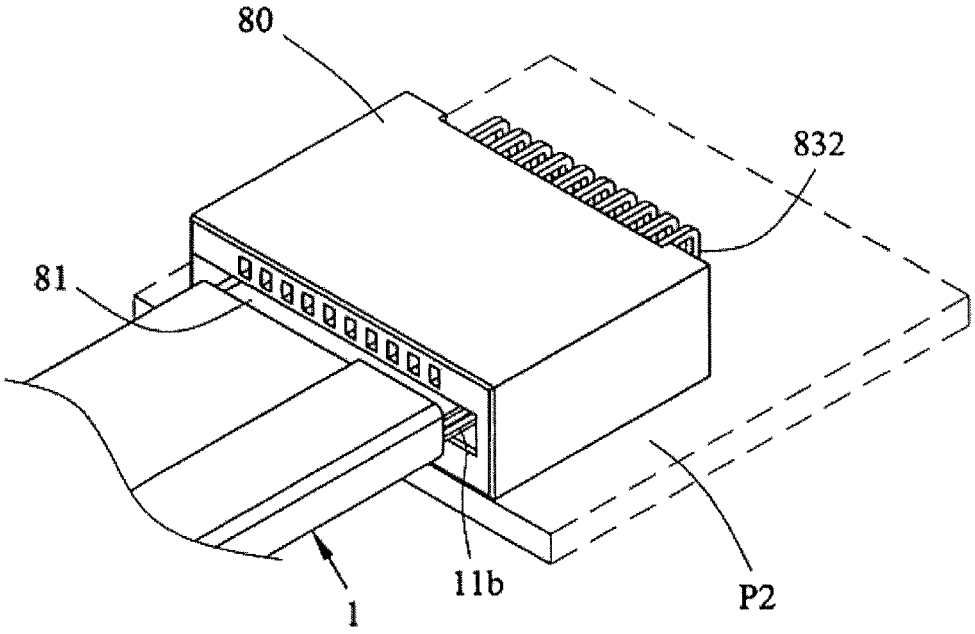
FIG. 11 is a schematic three-dimensional view of assembling the FFC connector to the FFC and separating from the second PCB according to a third preferred embodiment of the present invention.

Referring to FIG. 8 and FIG. 9, the FFC connector 70 further includes a pair of buckling parts 79 on the outer side of the insulating housing 70*a* and a holding part 90 is disposed in the front end 11*a* of FFC 1 wherein the holding part 90 includes a pair of resilient hooks 91 for hooking the front end 11*a* of FFC 1 to the pair of buckling parts 79 of FFC connector 70 to prevent the FFC 1 from the FFC connector 70 due to external force. If there is a need to separate the FFC 1 from the FFC connector 70, the pair of resilient hooks 91 is pressed to release the pair of resilient hooks 91 from the pair of buckling parts 79 of insulating housing 70*a* for withdrawing the FFC 1 from the FFC connector 70.

Referring to FIG. 1, and FIG. 10 through FIG. 14, the flexible flat cable connector 80 in the present invention includes an insulating housing 80*a* and a plurality of terminals 83 wherein the front end of the insulating housing 80*a* includes a plurality of first terminal holes 801 which are arranged in a upward/downward dual-row configuration to form a first insertion space 81. Each terminal 83 extends forward to form a first resilient portion 831 and extends backward to form a plurality of soldering portions 832 wherein the terminals 83 are secured inside the insulating housing 80*a* in a upward/downward dual-row configuration. For example, a plurality of grooves 803 are disposed in the insulating housing 80*a* and piercer 833 of each terminal 83 embeds to grooves 803. The first resilient portions 831 are inserted to the first insertion space 81 and are arranged within the first insertion space 81 in form of a upward/downward dual-row configuration. The soldering portions 832 are arranged in and exposed from the rear end of the insulating housing 80*a* wherein the soldering portions 832 are disposed in the second PCB P2 including a plurality of conductors P25 for electrically connecting the soldering portions 832 to the conductors P25 of second PCB P2, as shown FIGS. 10, 13 and 14. Furthermore, the first insertion space 81 is inserted by the FFC 1 including a plurality of first conductors 50 and a plurality of second conductors 60 wherein the first conductors 50 and second conductors 60 are exposed from the rear end 11*b* of FFC 1. When the first insertion space 81 is inserted by the rear end 11*b* of FFC 1, first resilient portions 831 clamps the rear end 11*b* of FFC 1 so that the first resilient portions 831 electrically connects the first conductors 50 and second conductors 60 respectively in order to insert the FFC into or remove the FFC from the FFC connector 80 repeatedly.

Figure 12:
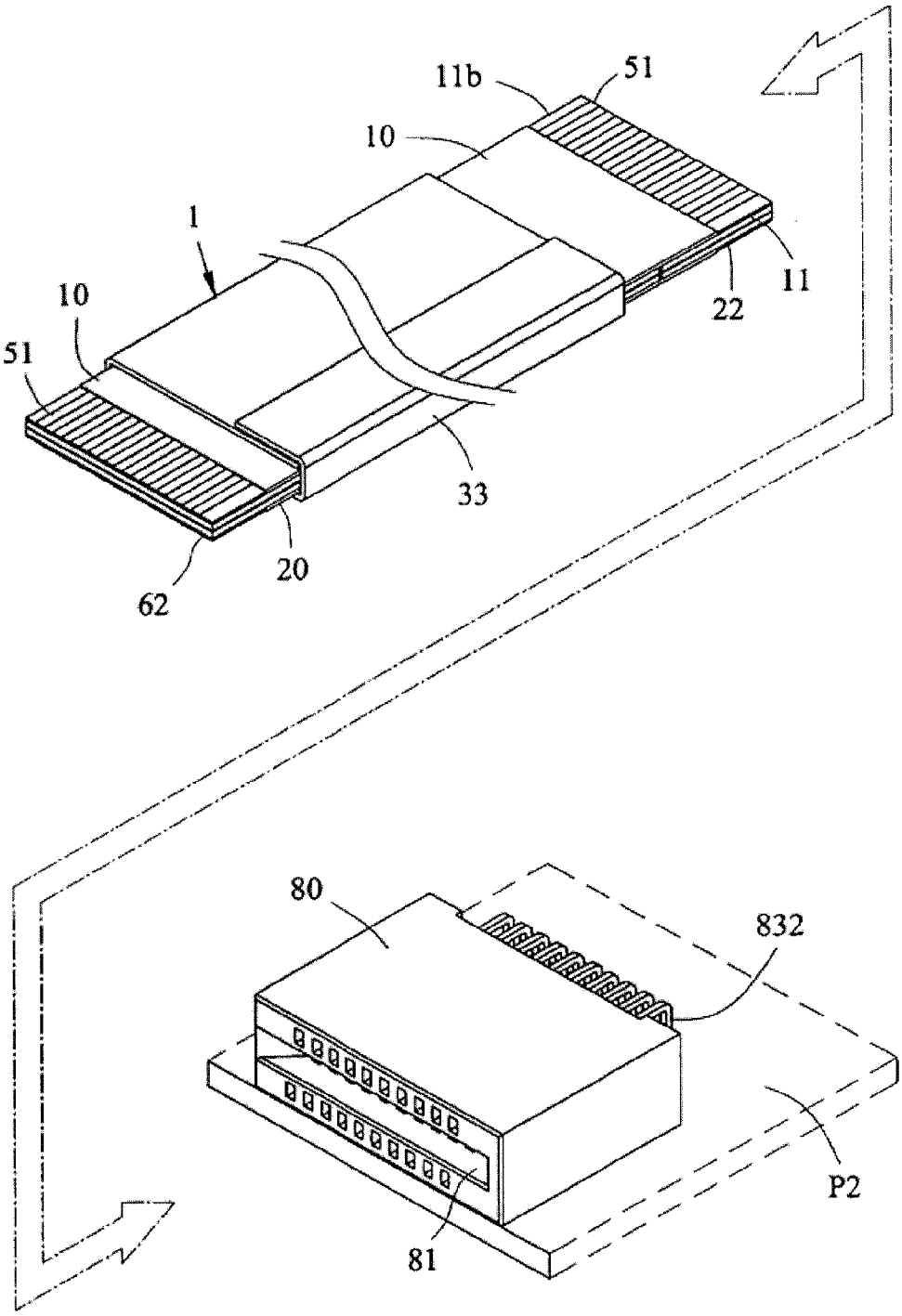
FIG. 12 is a schematic three-dimensional view of assembling the FFC connector to the FFC and connecting the FFC connector to the second PCB according to a third preferred embodiment of the present invention.
Figure 13:
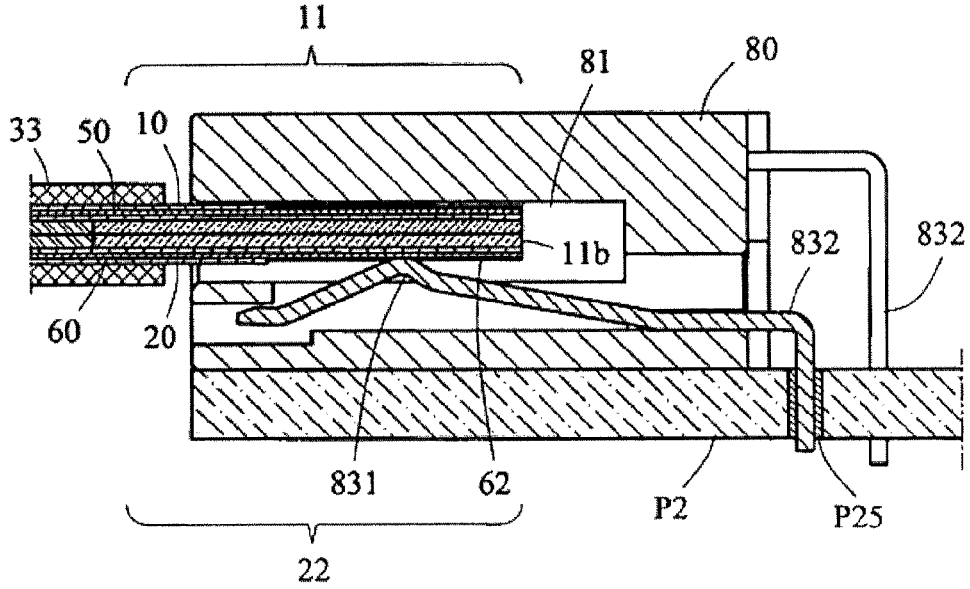
FIG. 13 is a schematic cross-sectional view of assembling the FFC connector to the FFC and connecting the FFC connector to the second PCB according to a third preferred embodiment of the present invention.
Figure 14:
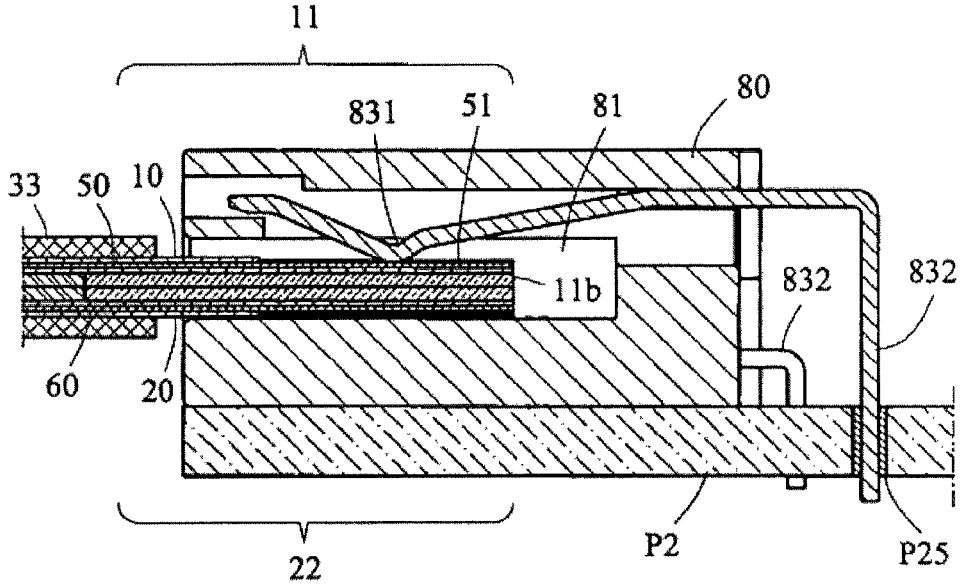
FIG. 14 is another schematic cross-sectional view of assembling the FFC connector to the FFC and connecting the FFC connector to the second PCB according to a third preferred embodiment of the present invention.

The embodiments, implements and advantages of FFC connector 80 and FFC 1 are described below. The FFC 1 covers the first conductors 50 by first insulation layer 10 and covers the second conductors 60 by second insulation layer 20. A first shielding layer 31 is disposed between the first insulation layer 10 and second insulation layer 20. A third shielding layer 33 covers the outer surface of a main body section 12. The first contact surface region 51 of first conductors 50 is exposed from the first contact section 11 of first insulation layer 10 and the second contact surface region 62 of second conductors 60 is exposed from the second contact section 22 of second insulation layer 20. When the first insertion space 81 is inserted by the rear end 11*b* of FFC 1, first resilient portions 931 clamps the rear end 11*b* of FFC 1 which is composed of first contact section 11 and second contact section 22 so that the first resilient portions 831 electrically connect the first contact surface region 51 and second contact surface region 62 respectively. Thus, FFC connector 80 can be easily plugged by FFC 1 for electrically connecting the second PCB P2 to the FFC 1 by way of the FFC connector 80. Furthermore, the FFC 1 can be extracted from the FFC connector 80 on demand in order to release the electrical connection between the second PCB P2 and the FFC 1, as shown in FIG. 12, thus for repairing the electronic device attached to the second PCB P2 advantageously and for inserting the FFC 1 into or removing the FFC 1 from the FFC 1 connector 80 repeatedly.

Figure 15:
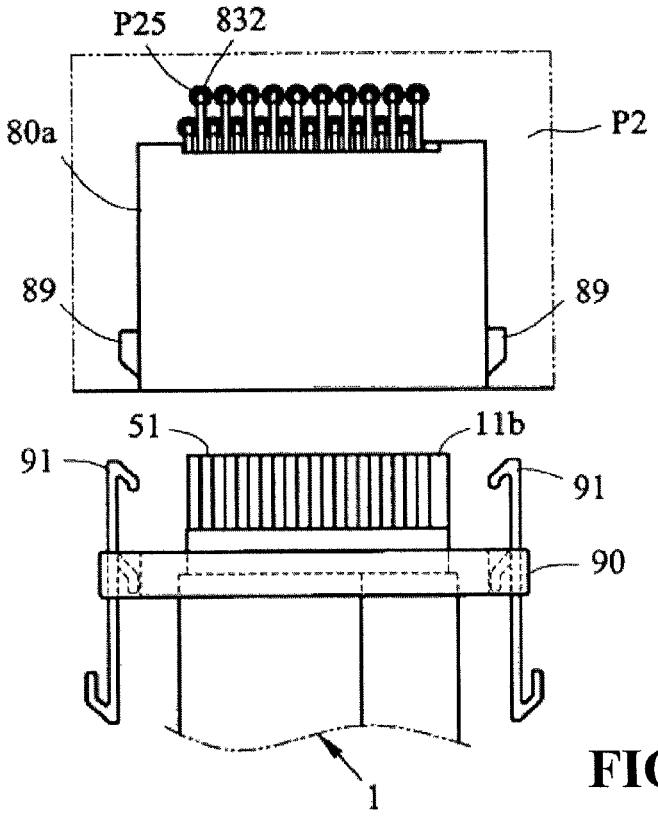
FIG. 15 is a schematic planar view of separating the FFC connector from the FFC according to a fourth preferred embodiment of the present invention.
Figure 16:
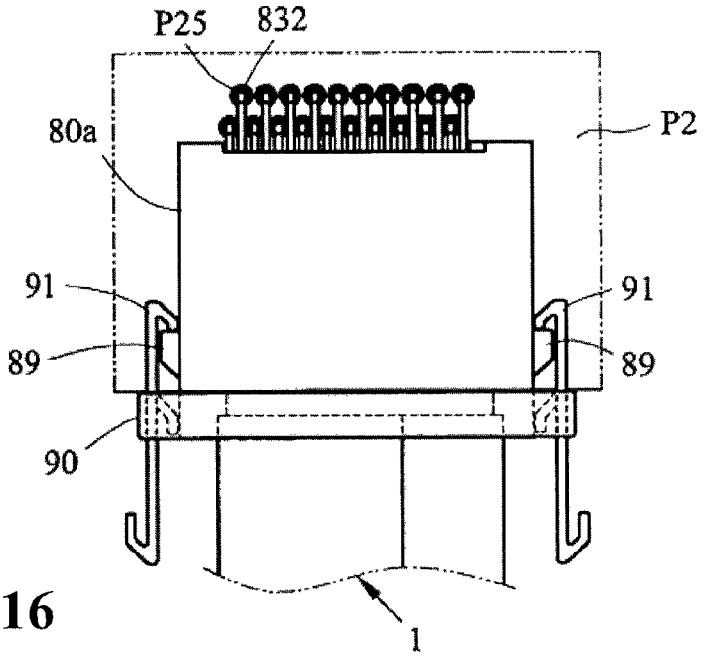
FIG. 16 is a schematic planar view of assembling the FFC connector to the FFC according to a fourth preferred embodiment of the present invention.
Figure 17:
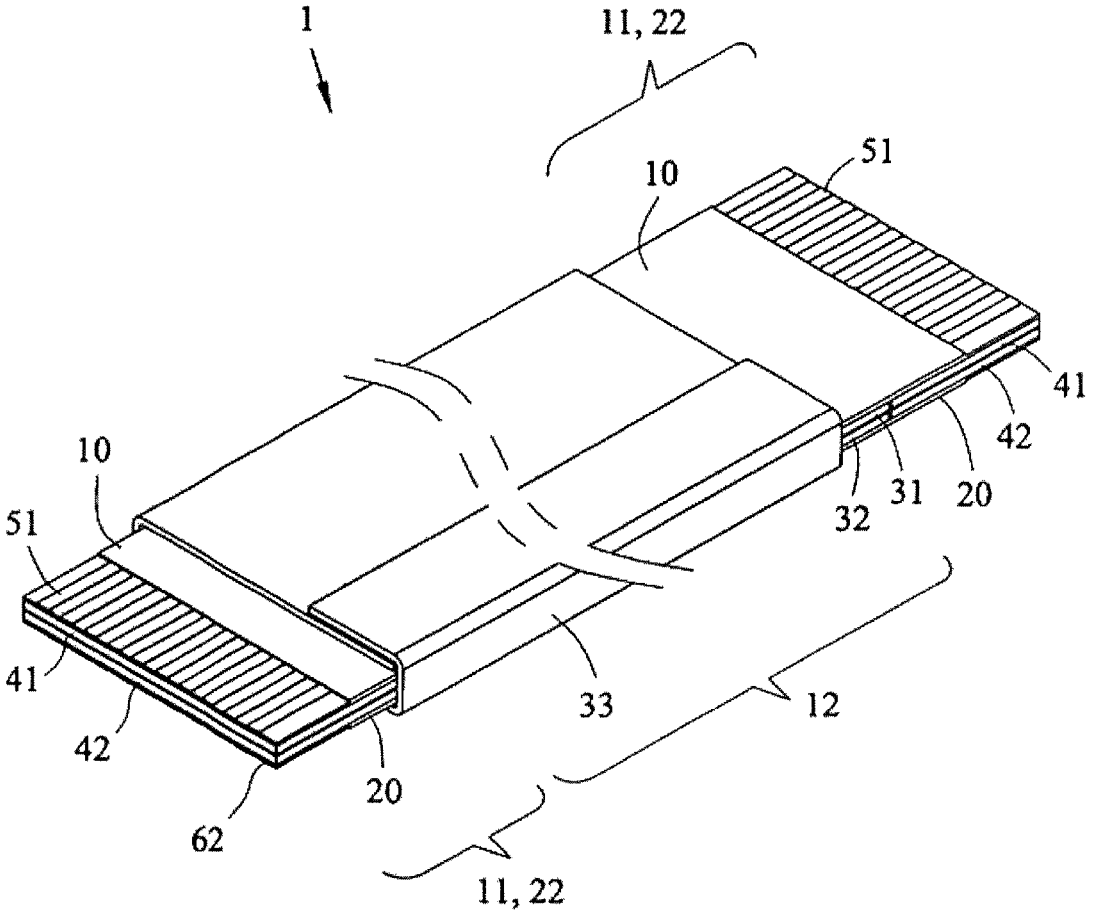
FIG. 17 is a schematic exploded three-dimensional view of the FFC according to a first preferred embodiment of the present invention.
Figure 18:
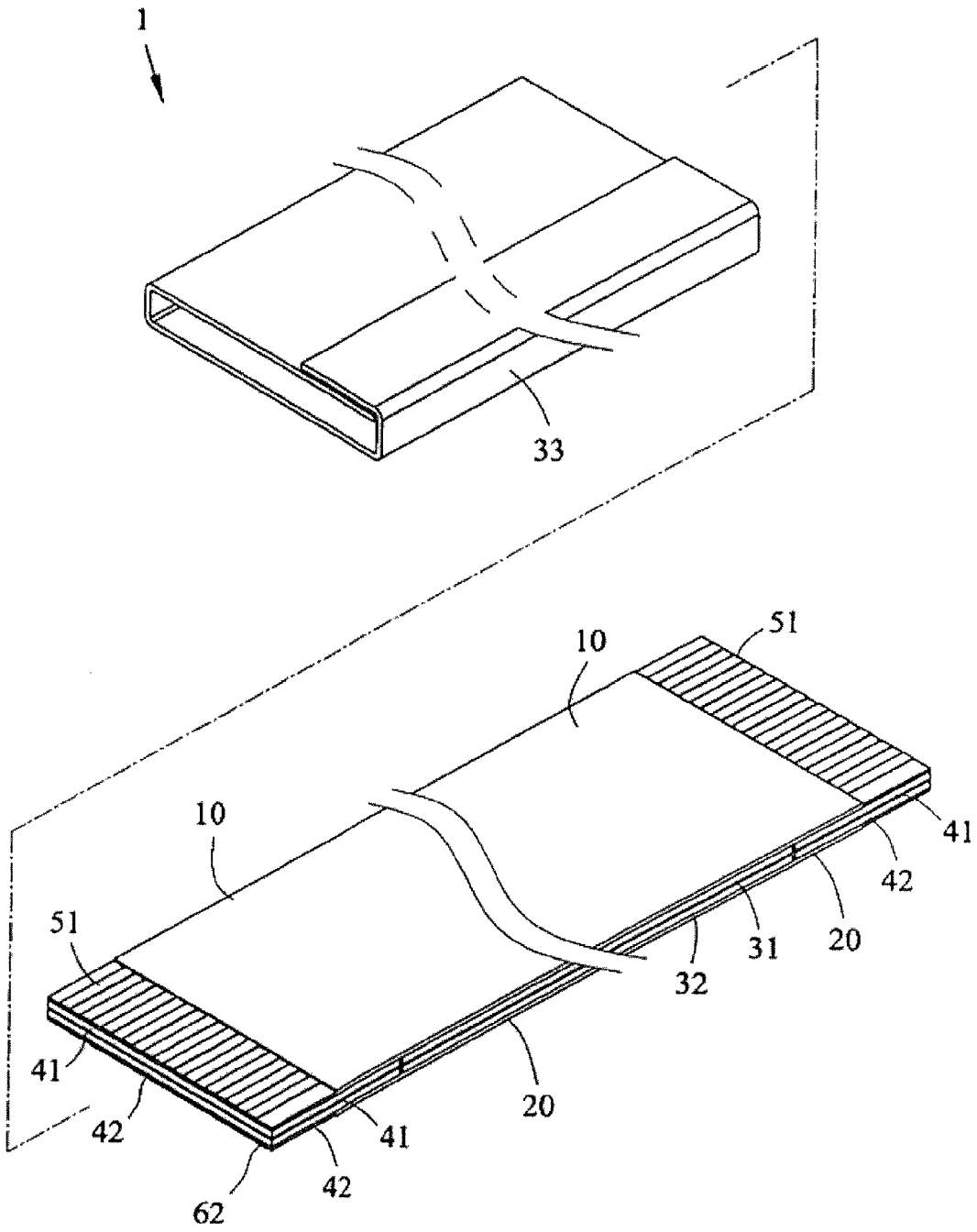
FIG. 18 is a schematic three-dimensional view of the FFC according to a first preferred embodiment of the present invention.
Figure 19:
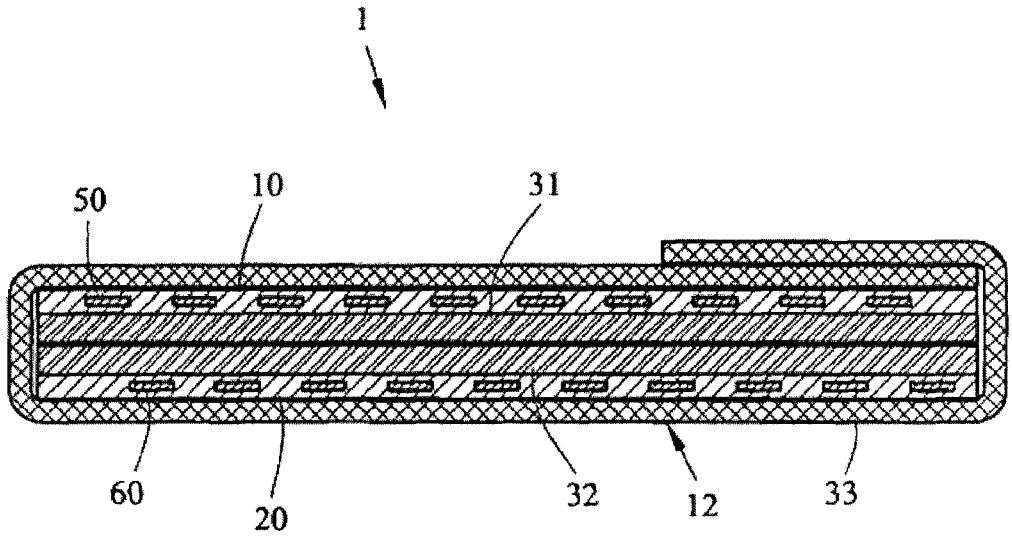
FIG. 19 is a schematic cross-sectional view of a main body section of the FFC according to a first preferred embodiment of the present invention.
Figure 20:
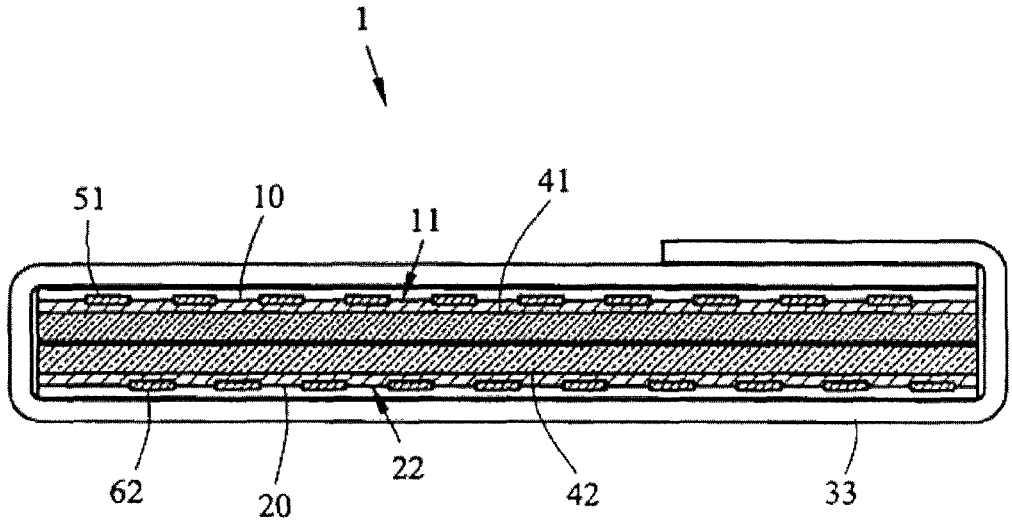
FIG. 20 is a schematic cross-sectional view of a contact section of the FFC according to a first preferred embodiment of the present invention.

Referring to FIG. 15 and FIG. 16, the FFC connector 80 further includes a pair of buckling parts 89 on the outer side of the insulating housing 80*a* and a holding part 90 is disposed in the rear end 11*b* of FFC 1 wherein the holding part 90 includes a pair of resilient hooks 91 for hooking the rear end 11*b* of FFC 1 to the pair of buckling parts 89 of FFC connector 80 to prevent the FFC 1 from the FFC connector 80 due to external force. If there is a need to separate the FFC 1 from the FFC connector 80, the pair of resilient hooks 91 is pressed to release the pair of resilient hooks 91 from the pair of buckling parts 89 of insulating housing 80*a* for withdrawing the FFC 1 from the FFC connector 80.

Referring to FIG. 17 through FIG. 20, the FFC 1 in the present invention includes a first insulation layer 10, a second insulation layer 20, a first shielding layer 31 and a second shielding layer 32. The first insulation layer 10 covers a plurality of first conductors 50 and includes a first contact section 11 in the front end of the first insulation layer 10 wherein the first contact section 11 exposes a first contact surface region 51 of the first conductors 50. The second insulation layer 20 covers a plurality of second conductors 60 and includes a second contact section 22 in the front end of the second insulation layer 20 wherein the second contact section 22 exposes a second contact surface region 62 of second conductors 60. The first shielding layer 31 and second shielding layer 32 are disposed, for an example of a glue manner, between the first insulation layer 10 and second insulation layer 20. The first contact surface region 51 of the first conductors 50 is upwardly exposed from the first contact section 11 and the second contact surface region 62 of the second conductors 60 is downwardly exposed from the second contact section 22 so that flexible flat cable 1 is arranged in a dual-row manner to reduce the width of flexible flat cable 1 as a whole. Furthermore, the first insulation layer 10, the first shielding layer 31, the second shielding layer 32 and the second insulation layer 20 are sequentially stacked to enhance the strength of the flexible flat cable 1. In one case, the first conductors 50 and the second conductors 60 are interlaced upward and downward, as show in FIG. 19 and FIG. 20, based on different high frequency characteristics. In another case, the first conductors 50 and the second conductors 60 are disposed correspondingly upward and downward (not shown) based on different high frequency characteristics.

Furthermore, the first insulation layer 10 includes another first contact section 11 in the rear end of the first insulation layer 10 wherein another first contact surface region 51 of the first conductors 50 is upwardly exposed from the first contact section 11 in the rear end of the first insulation layer 10. The second insulation layer 20 includes another second contact section 22 in the rear end of the second insulation layer 20 wherein a second contact surface region 62 of the second conductors 60 is downwardly exposed from the second contact section 22 in the rear end of the second insulation layer 20. In one embodiment, first shielding layer 31 and the second shielding layer 32 extend to the in-between position of the first contact section 11 and second contact section 22 to improve the construction strength and shielding effect of flexible flat cable 1. In another embodiment, a first insulation supporting plate 41 and a second insulation supporting plate 42 are disposed in the in-between position of the first contact section 11 and second contact section 22 to improve the construction strength and shielding effect of flexible flat cable 1. The material of first shielding layer 31 and second shielding layer 32 is selected from one group consisting of aluminum foil, polytetrafluoroethylene (Teflon), acetate cloth insulating tape and the material with electromagnetic shielding effect. A third shielding layer 33 further covers the outer surface of a main body section 12 and is the material selecting from one group consisting of aluminum foil, polytetrafluoroethylene (Teflon), acetate cloth insulating tape and the material with electromagnetic shielding effect.

Figure 21:
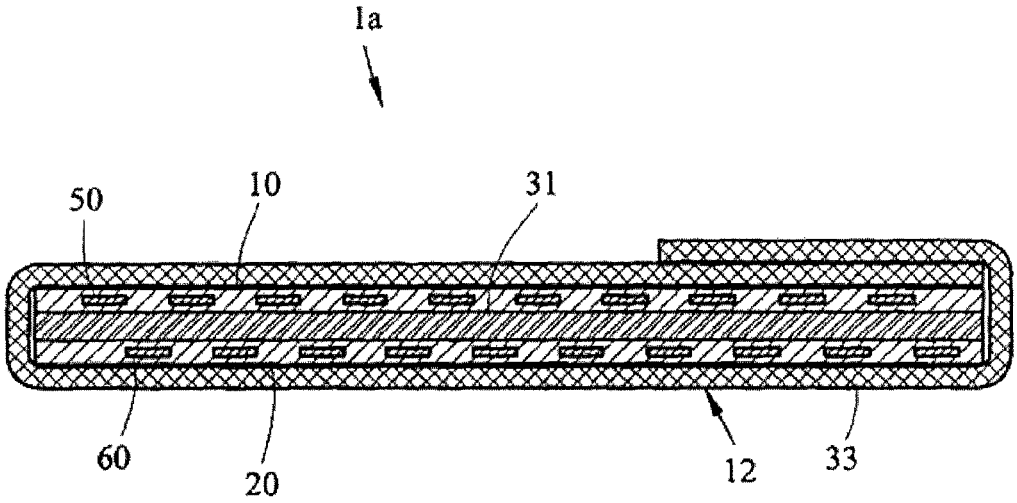
FIG. 21 is a schematic cross-sectional view of a main body section of the FFC, according to a second preferred embodiment of the present invention.
Figure 22:
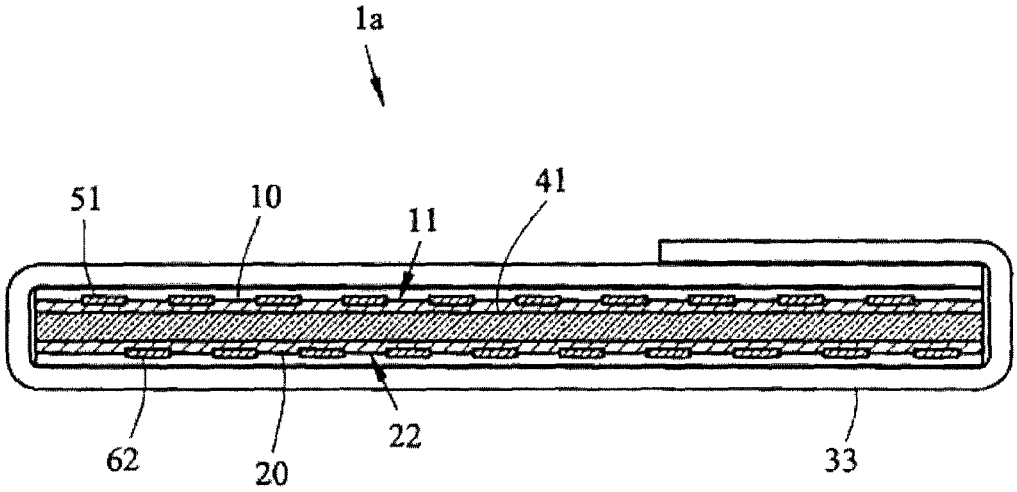
FIG. 22 is a schematic cross-sectional view of a contact section of the FFC according to a second preferred embodiment of the present invention.

Referring to FIGS. 21 and 22, the flexible flat cable 1*a* in the second embodiment is substantially similar to the flexible flat cable 1 in the preferred embodiment. The difference is that only a first shielding layer 31 is disposed between the first insulation layer 10 and the second insulation layer 20 and only a first insulation supporting plate 41 is disposed between the first contact section 11 and second contact section 22 in the second embodiment of the present invention.

Figure 23:
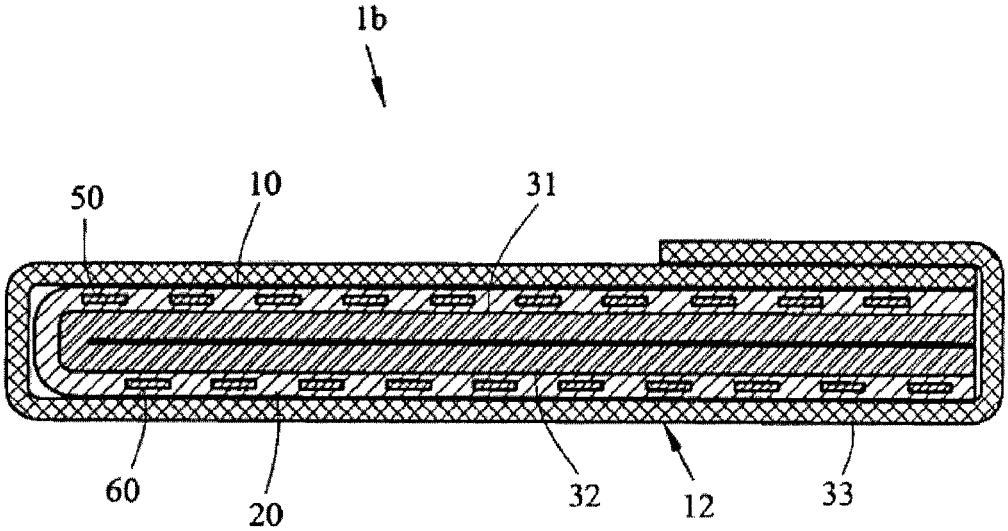
FIG. 23 is a schematic cross-sectional view of a main body section of the FFC according to a third preferred embodiment of the present invention.
Figure 24:
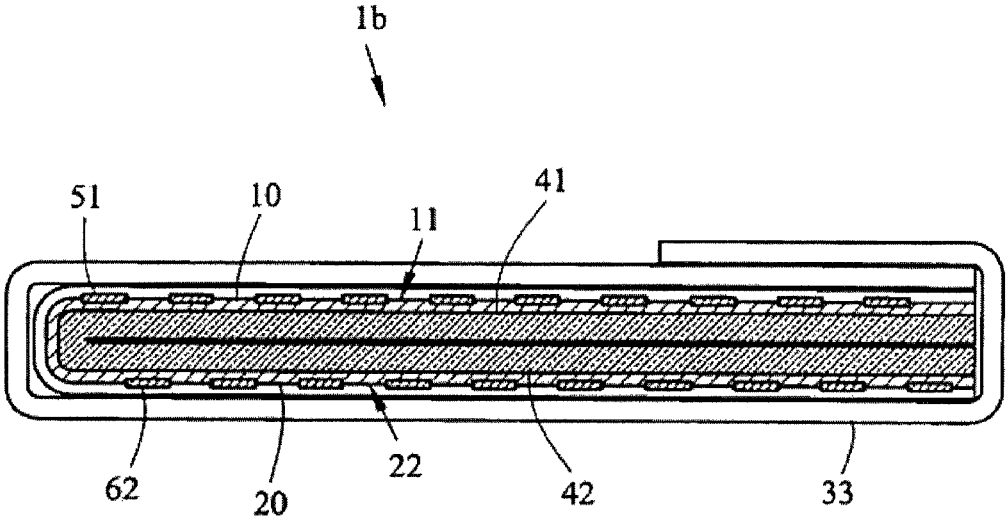
FIG. 24 is a schematic cross-sectional view of a contact section of the FFC according to a third preferred embodiment of the present invention.

Referring to FIGS. 23 and 24, the flexible flat cable 1*b* in the third embodiment is substantially similar to the flexible flat cable 1 in the preferred embodiment. The difference is that the first insulation layer 10 and the second insulation layer 20 are formed by bending an identical insulation layer such that the first insulation layer 10, the first shielding layer 31 and the second insulation layer 20 sequentially stacked to form the flexible flat cable 1*b*. In one case, the first shielding layer 31 is formed by single layer structure and disposed, e.g. at a glue manner, between the first insulation layer 10 and second insulation layer 20. In another case, a dual-row structure including the first shielding layer 31 and the second shielding layer 32 is formed by bending a shielding layer and is disposed between the first insulation layer 10 and second insulation layer 20. Furthermore, in one embodiment, only a first insulation supporting plate 41 is disposed between the first contact section 11 and the second contact section 22, or in another embodiment, a first insulation supporting plate 41 and a second insulation supporting plate 42 are disposed between the first contact section 11 and the second contact section 22. For example, a first insulation supporting plate 41 and a second insulation supporting plate 42 are formed by bending an identical insulation supporting plate. In one case, the first conductors 50 and the second conductors 60 are interlaced upward and downward, as show in FIGS. 23 and 24, based on different high frequency characteristics. In another case, the first conductors 50 and the second conductors 60 are disposed correspondingly upward and downward (not shown) based on different high frequency characteristics.

Figure 25:
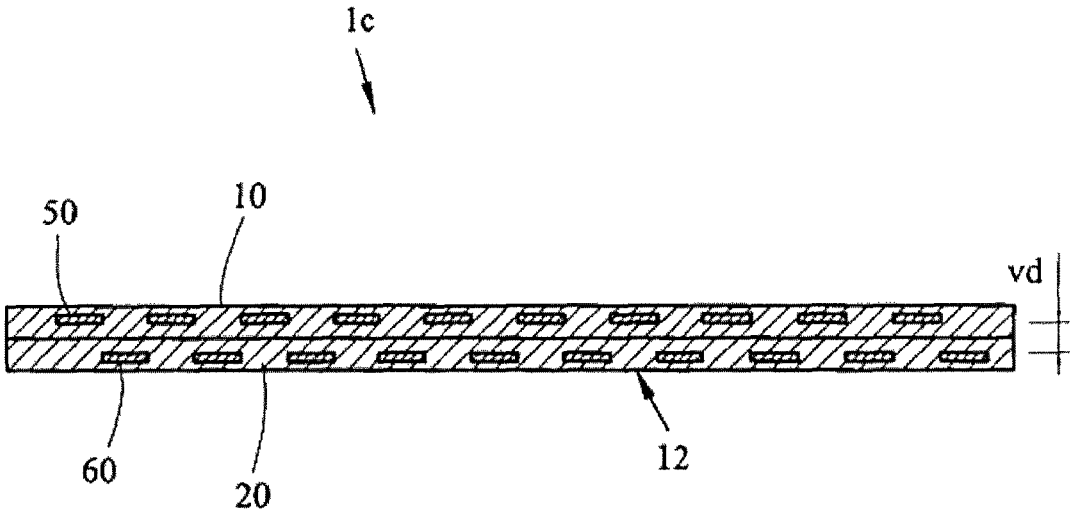
FIG. 25 is a schematic cross-sectional view of a main body section of the FFC according to a fourth preferred embodiment of the present invention.

Referring to FIG. 25, the flexible flat cable 1*c* in the fourth embodiment is substantially similar to the flexible flat cable 1 in the preferred embodiment. The difference is that the flexible flat cable 1*c* is formed by sequentially stacking, e.g. at a glue manner, the first insulation layer 10 and the second insulation layer 20, wherein either the first insulation layer 10 and the second insulation layer 20 is an individual insulation layer respectively or the first insulation layer 10 and the second insulation layer 20 are formed, e.g. at a glue manner, by bending an identical insulation layer. For example, either a vertical distance "vd" from first conductors 50 from second conductors 60 is greater than twice the thickness of the first conductors 50, or the vertical distance "vd" from first conductors 50 to second conductors 60 is greater than the thickness of the second conductors 60. In one case, the first conductors 50 and the second conductors 60 are interlaced upward and downward to achieve the required high frequency characteristics.

Figure 26:
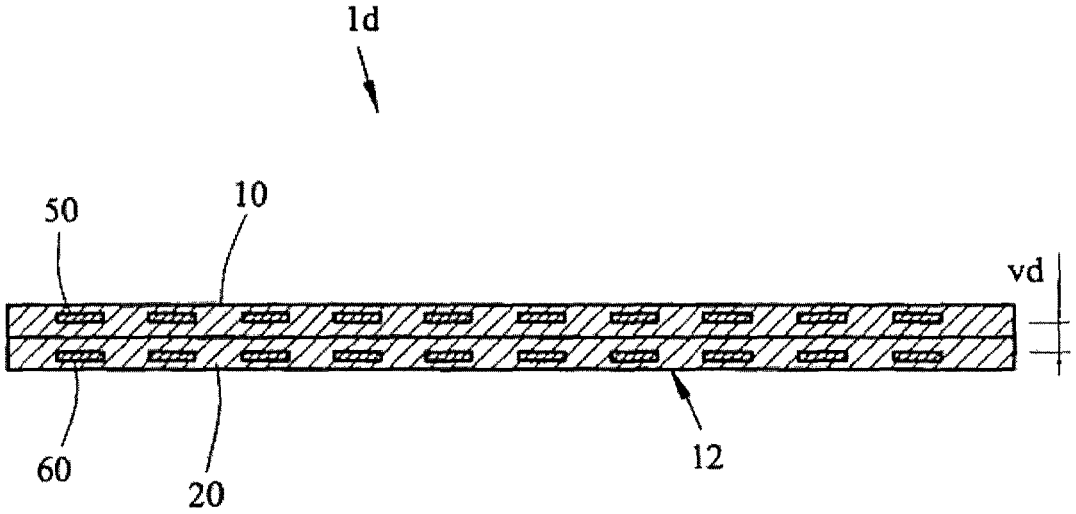
FIG. 26 is a schematic cross-sectional view of a main body section of the FFC according to a sixth preferred embodiment of the present invention.

Referring to FIG. 26, the flexible flat cable 1*d* in the fifth embodiment is substantially similar to the flexible flat cable 1 in the preferred embodiment. The difference is that the flexible flat cable 1*d* is formed by sequentially stacking, e.g. at a glue manner, the first insulation layer 10 and the second insulation layer 20, wherein the first insulation layer 10 and the second insulation layer 20 is an individual insulation layer respectively or the first insulation layer 10 and the second insulation layer 20 is formed, e.g. at a glue manner, by bending an identical insulation layer. For example, either a vertical distance "vd" from first conductors 50 to second conductors 60 is greater than twice the thickness of the first conductors 50, or the vertical distance "vd" from first conductors 50 to second conductors 60 is greater than the thickness of the second conductors 60. In another case, the first conductors 50 and the second conductors 60 are disposed correspondingly upward and downward to achieve the required high frequency characteristics.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A flexible flat cable connector, comprising:

an insulating housing having a plurality of first terminal holes in a front end of the insulating housing and having a plurality of second terminal holes in a rear end of the insulating housing, wherein the first terminal holes and the second terminal holes are arranged in an upward/downward dual-row configuration to form a first insertion space and a second insertion space respectively; and a plurality of terminals, forwardly extending each terminal to form a first resilient portion and backwardly extending to form a second resilient portion, wherein the terminals are secured inside the insulating housing in the upward/downward dual-row configuration, the first resilient portions are inserted to the first insertion space via the first terminal holes respectively and arranged in the upward/downward dual-row configuration, and the second resilient portions are inserted to the second insertion space via the second terminal holes respectively and arranged in the upward/downward dual-row configuration wherein a FFC can be inserted into the second insertion space, the FFC comprises a plurality of first conductors and a plurality of second conductors, the first conductors and the second conductors are exposed from the front end of the FFC, and the second resilient portions are arranged in the upward/downward dual-row configuration for clamping the front end of the FFC to allow the second resilient portions to electrically contact the first conductors and the second conductors respectively.

2. The flexible flat cable connector of claim 1, wherein an edge portion of a first PCB can be inserted into the first insertion space, and a front-side and a backside of the edge portion respectively comprise a plurality of conducting portions to allow the first resilient portions to fasten the edge portion and electrically contact the conducting portions on the front-side and the backside of the edge portion respectively.

3. The flexible flat cable connector of claim 1, wherein an edge portion of a first PCB can be inserted into the first insertion space, the first PCB comprises a slot and a position portion, a front-side and a backside of the edge portion respectively comprise a plurality of conducting portions, a lateral side of the insulating housing is embedded to the slot of the first PCB and a position block of the insulating housing is buckled to the position portion of the first PCB, and the first resilient portions fasten the edge portion and electrically contact the conducting portions on the front-side and the backside of the edge portion respectively.

4. The flexible flat cable connector of claim 1, wherein a holding part is disposed in the front end of the FFC wherein the holding part comprises a pair of resilient hooks for hooking the front end to the pair of buckling parts of the FFC connector.

5. The flexible flat cable connector of claim 1, wherein the FFC covers the first conductors by a first insulation layer and covers the second conductors by a second insulation layer, the first insulation layer and the second insulation layer are formed by bending an identical insulation layer, a first shielding layer and a second shielding layer are disposed between the first insulation layer and the second insulation layer, and a third shielding layer covers an outer surface of a main body section.

6. The flexible flat cable connector of claim 1, wherein the FFC covers the first conductors by a first insulation layer and covers the second conductors by a second insulation layer, a first shielding layer and a second shielding layer are disposed between the first insulation layer and the second insulation layer, and a third shielding layer covers an outer surface of a main body section.

7. The flexible flat cable connector of claim 1, wherein the FFC covers the first conductors by a first insulation layer and covers the second conductors by a second insulation layer, the first insulation layer and the second insulation layer are formed by bending an identical insulation layer, a first shielding layer is disposed between the first insulation layer and the second insulation layer, and a third shielding layer covers an outer surface of a main body section.

8. The flexible flat cable connector of claim 7, wherein a first contact surface region of the first conductors is exposed from a first contact section of the first insulation layer, a second contact surface region of the second conductors is exposed from a second contact section of the second insulation layer, the second resilient portions clamps the first contact section and the second contact section for electrically connecting the first contact surface region and second contact surface region respectively, and the first shielding layer extends to an in-between position of the first contact section and the second contact section.

9. The flexible flat cable connector of claim 7, wherein a first contact surface region of the first conductors is exposed from a first contact section of the first insulation layer, a second contact surface region of the second conductors is exposed from a second contact section of the second insulation layer, the second resilient portions clamps the first contact section and the second contact section for electrically connecting the first contact surface region and second contact surface region respectively, and a first insulation supporting plate is disposed in an in-between position of the first contact section and second contact section.

10. The flexible flat cable connector of claim 7, wherein a first contact surface region of the first conductors is exposed from a first contact section of the first insulation layer, a second contact surface region of the second conductors is exposed from a second contact section of the second insulation layer, the second resilient portions clamps the first contact section and the second contact section for electrically connecting the first contact surface region and second contact surface region respectively, and the first shielding layer and the second shielding layer extend to an in-between position of the first contact section and the second contact section.

11. The flexible flat cable connector of claim 7, wherein a first contact surface region of the first conductors is exposed from a first contact section of the first insulation layer, a second contact surface region of the second conductors is exposed from a second contact section of the second insulation layer, the second resilient portions clamps the first contact section and the second contact section for electrically connecting the first contact surface region and second contact surface region respectively, and a first insulation supporting plate and a second insulation supporting plate are disposed in an in-between position of the first contact section and second contact section.

12. The flexible flat cable connector of claim 1, wherein the FFC covers the first conductors by a first insulation layer and covers the second conductors by a second insulation layer, and a vertical distance between the first conductors and the second conductors is greater than twice the thickness of either the first conductors or the second conductors.

13. The flexible flat cable connector of claim 12, wherein the first insulation layer and the second insulation layer are stacked to be adhered together by using glue, the first insulation layer and the second insulation layer is an individual insulation layer respectively or the first insulation layer and the second insulation layer are formed by bending an identical insulation layer.

14. The flexible flat cable connector of claim 12, wherein the first conductors and the second conductors are interlaced upward and downward or the first conductors and the second conductors are disposed correspondingly upward and downward.

15. The flexible flat cable connector of claim 1, wherein the FFC covers the first conductors by a first insulation layer and covers the second conductors by a second insulation layer, a first shielding layer is disposed between the first insulation layer and the second insulation layer, and a third shielding layer covers an outer surface of a main body section.

16. The flexible flat cable connector of claim 15, wherein a first contact surface region of the first conductors is exposed from a first contact section of the first insulation layer, a second contact surface region of the second conductors is exposed from a second contact section of the second insulation layer, the first resilient portions clamps the first contact section and the second contact section for electrically connecting the first contact surface region and second contact surface region respectively, and the first shielding layer extends to an in-between position of the first contact section and the second contact section.

17. The flexible flat cable connector of claim 15, wherein a first contact surface region of the first conductors is exposed from a first contact section of the first insulation layer, a second contact surface region of the second conductors is exposed from a second contact section of the second insulation layer, the first resilient portions clamps the first contact section and the second contact section for electrically connecting the first contact surface region and second contact surface region respectively, and a first insulation supporting plate is disposed in an in-between position of the first contact section and second contact section.

18. The flexible flat cable connector of claim 15, wherein a first contact surface region of the first conductors is exposed from a first contact section of the first insulation layer, a second contact surface region of the second conductors is exposed from a second contact section of the second insulation layer, the first resilient portions clamps the first contact section and the second contact section for electrically connecting the first contact surface region and second contact surface region respectively, and the first shielding layer and the second shielding layer extend to an in-between position of the first contact section and the second contact section.

19. The flexible flat cable connector of claim 15, wherein a first contact surface region of the first conductors is exposed from a first contact section of the first insulation layer, a second contact surface region of the second conductors is exposed from a second contact section of the second insulation layer, the first resilient portions clamps the first contact section and the second contact section for electrically connecting the first contact surface region and second contact surface region respectively, and a first insulation supporting plate and a second insulation supporting plate are disposed in an in-between position of the first contact section and second contact section.

* * * * *